US006385926B1

(12) United States Patent
Kizar

(10) Patent No.: US 6,385,926 B1
(45) Date of Patent: May 14, 2002

(54) DECORATIVE WINDOW-MOUNTING APPARATUS

(76) Inventor: Jessie L. Kizar, 2403 E. 5th St., Lumberton, NC (US) 28358

( * ) Notice: Subject to any disclaimer, the term of this patent is extended or adjusted under 35 U.S.C. 154(b) by 0 days.

(21) Appl. No.: 09/569,451

(22) Filed: May 12, 2000

(51) Int. Cl.[7] ..... E06B 1/04

(52) U.S. Cl. ..... 52/211; 52/311.2; 428/7; 428/99

(58) Field of Search ..... 428/99, 7, 14; 52/311.1, 211, 212, 311.2

(56) References Cited

U.S. PATENT DOCUMENTS 3,855,746 A 12/1974 Leggiere
3,943,662 A 3/1976 La Rosa
4,248,018 A 2/1981 Casamayor
5,018,325 A * 5/1991 Geen et al. ..... 52/211
5,306,535 A 4/1994 Shaffer
5,411,780 A 5/1995 Kaefer
D378,332 S 3/1997 Simoni

* cited by examiner

*Primary Examiner*—Alexander S. Thomas

(57) ABSTRACT

A decorative window-mounting apparatus for providing easy-to-setup decorations about the interior and exterior of a house. The decorative window-mounting apparatus includes a window molding having a first pair of vertically-disposed elongate members being adapted to fasten to a window frame about a window, and further having a horizontally-disposed upper cross member securely attached to the window frame above the window, and also having a horizontally-disposed lower cross member securely attached to the window frame below the window; and also includes a frame having a second pair of vertically-disposed elongate members removably attached to the first pair of vertically-disposed elongate members, and also having a second pair of horizontally-disposed cross members being removably mounted to the upper and lower cross members of the window molding; and further includes a plurality of holiday decorative members securely attached to the frame and extending outwardly therefrom.

13 Claims, 2 Drawing Sheets

DECORATIVE WINDOW-MOUNTING APPARATUS

BACKGROUND OF THE INVENTION

1. Field of the Invention

The present invention relates to window perimeter decorations and more particularly pertains to a new decorative window-mounting apparatus for providing easy-to-setup decorations about the interior and exterior of a house.

2. Description of the Prior Art

The use of window perimeter decorations is known in the prior art. More specifically, window perimeter decorations heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,411,780; 5,306,535; 4,248,018; 3,943,662; 3,855,746; and U.S. Pat. No. Des. 378,332.

While these devices fulfill their respective, particular objectives and requirements, the aforementioned patents do not disclose a new decorative window-mounting apparatus. The inventive device includes a window molding having a first pair of vertically-disposed elongate members being adapted to fasten to a window frame about a window, and further having a horizontally-disposed upper cross member securely attached to the window frame above the window, and also having a horizontally-disposed lower cross member securely attached to the window frame below the window; and also includes a frame having a second pair of vertically-disposed elongate members removably attached to the first pair of vertically-disposed elongate members, and also having a second pair of horizontally-disposed cross members being removably mounted to the upper and lower cross members of the window molding; and further includes a plurality of holiday decorative members securely attached to the frame and extending outwardly therefrom.

In these respects, the decorative window-mounting apparatus according to the present invention substantially departs from the conventional concepts and designs of the prior art, and in so doing provides an apparatus primarily developed for the purpose of providing easy-to-setup decorations about the interior and exterior of a house.

SUMMARY OF THE INVENTION

In view of the foregoing disadvantages inherent in the known types of window perimeter decorations now present in the prior art, the present invention provides a new decorative window-mounting apparatus construction wherein the same can be utilized for providing easy-to-setup decorations about the interior and exterior of a house.

The general purpose of the present invention, which will be described subsequently in greater detail, is to provide a new decorative window-mounting apparatus which has many of the advantages of the window perimeter decorations mentioned heretofore and many novel features that result in a new decorative window-mounting apparatus which is not anticipated, rendered obvious, suggested, or even implied by any of the prior art window perimeter decorations, either alone or in any combination thereof.

To attain this, the present invention generally comprises a window molding having a first pair of vertically-disposed elongate members being adapted to fasten to a window frame about a window, and further having a horizontally-disposed upper cross member securely attached to the window frame above the window, and also having a horizontally-disposed lower cross member securely attached to the window frame below the window; and also includes a frame having a second pair of vertically-disposed elongate members removably attached to the first pair of vertically-disposed elongate members, and also having a second pair of horizontally-disposed cross members being removably mounted to the upper and lower cross members of the window molding; and further includes a plurality of holiday decorative members securely attached to the frame and extending outwardly therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative window-mounting apparatus which has many of the advantages of the window perimeter decorations mentioned heretofore and many novel features that result in a new decorative window-mounting apparatus which is not anticipated, rendered obvious, suggested, or even implied by any of the prior art window perimeter decorations, either alone or in any combination thereof.

It is another object of the present invention to provide a new decorative window-mounting apparatus which may be easily and efficiently manufactured and marketed.

It is a further object of the present invention to provide a new decorative window-mounting apparatus which is of a durable and reliable construction.

An even further object of the present invention is to provide a new decorative window-mounting apparatus which is susceptible of a low cost of manufacture with regard to both materials and labor, and which accordingly is then susceptible of low prices of sale to the consuming public, thereby making such decorative window-mounting apparatus economically available to the buying public.

Still yet another object of the present invention is to provide a new decorative window-mounting apparatus which provides in the apparatuses and methods of the prior art some of the advantages thereof, while simultaneously overcoming some of the disadvantages normally associated therewith.

Still another object of the present invention is to provide a new decorative window-mounting apparatus for providing easy-to-setup decorations about the interior and exterior of a house.

Yet another object of the present invention is to provide a new decorative window-mounting apparatus which includes a window molding having a first pair of vertically-disposed elongate members being adapted to fasten to a window frame about a window, and further having a horizontally-disposed upper cross member securely attached to the window frame above the window, and also having a horizontally-disposed lower cross member securely attached to the window frame below the window; and also includes a frame having a second pair of vertically-disposed elongate members removably attached to the first pair of vertically-disposed elongate members, and also having a second pair of horizontally-disposed cross members being removably mounted to the upper and lower cross members of the window molding; and further includes a plurality of holiday decorative members securely attached to the frame and extending outwardly therefrom.

Still yet another object of the present invention is to provide a new decorative window-mounting apparatus that allows the user to easily and conveniently put up and take down decorations about one's house.

Even still another object of the present invention is to provide a new decorative window-mounting apparatus that reduces the possibility of decorations being lost.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
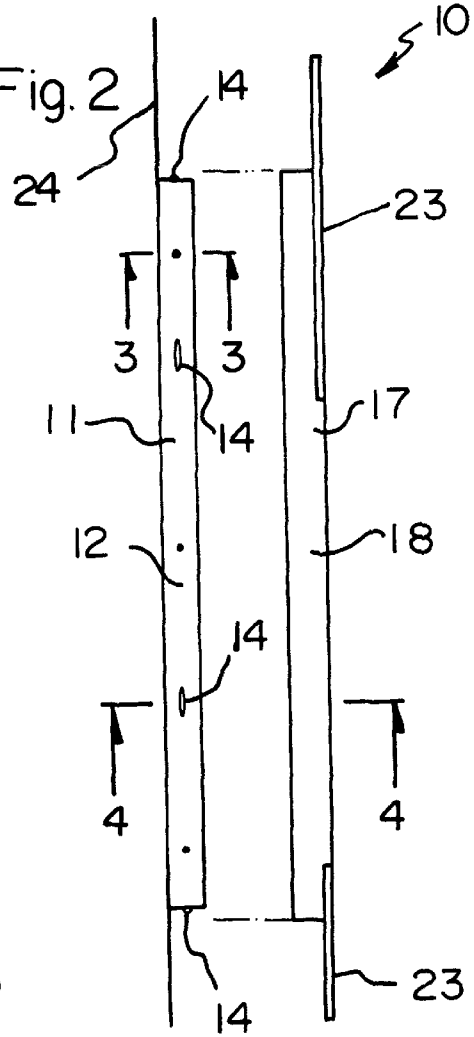
FIG. 2 is a side elevational view of the present invention.
Figure 1:
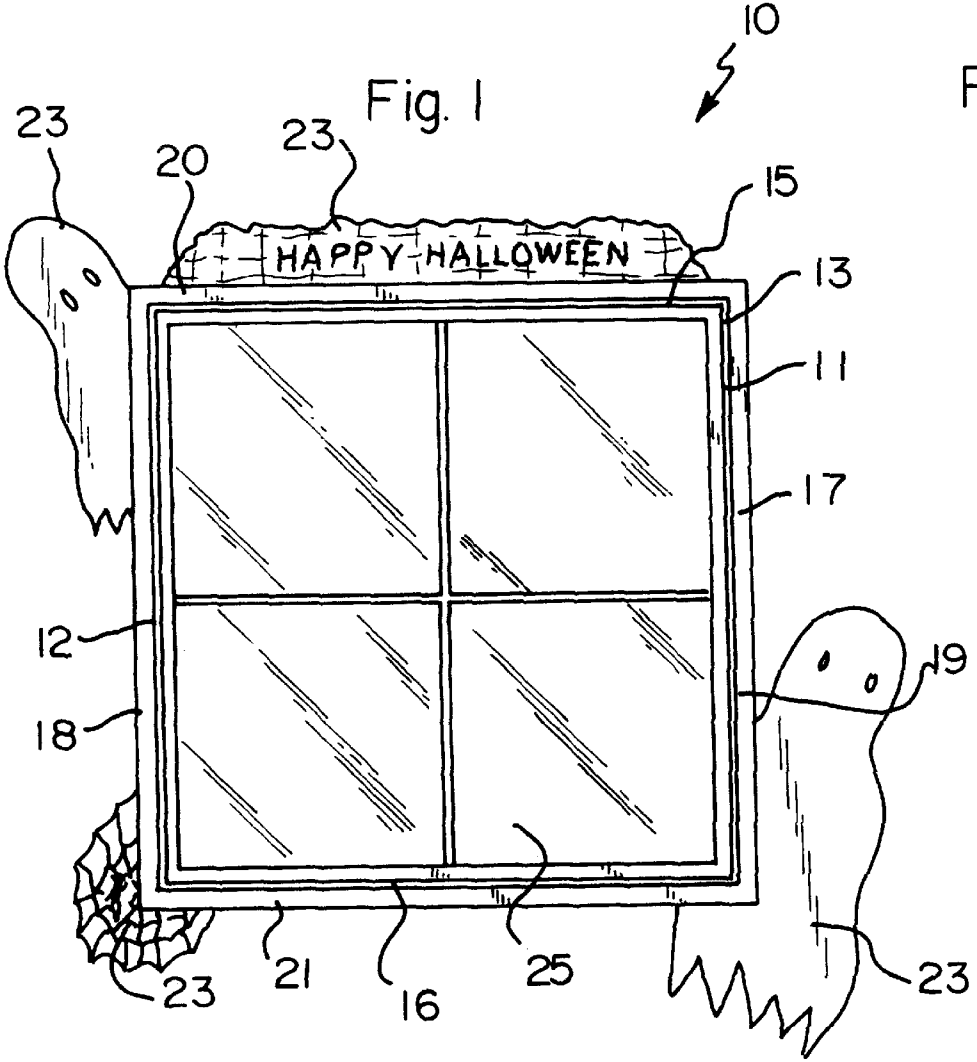
FIG. 1 is a front elevational view of a new decorative window-mounting apparatus according to the present invention.
Figure 3:
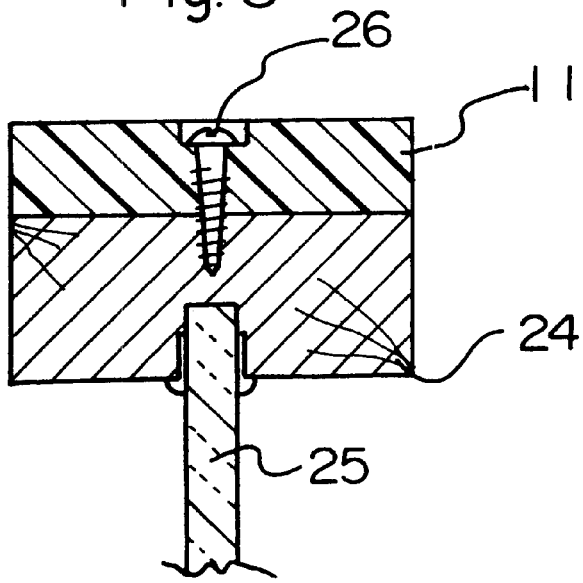
FIG. 3 is a cross sectional view of the window frame and window molding of the present invention.
Figure 4:
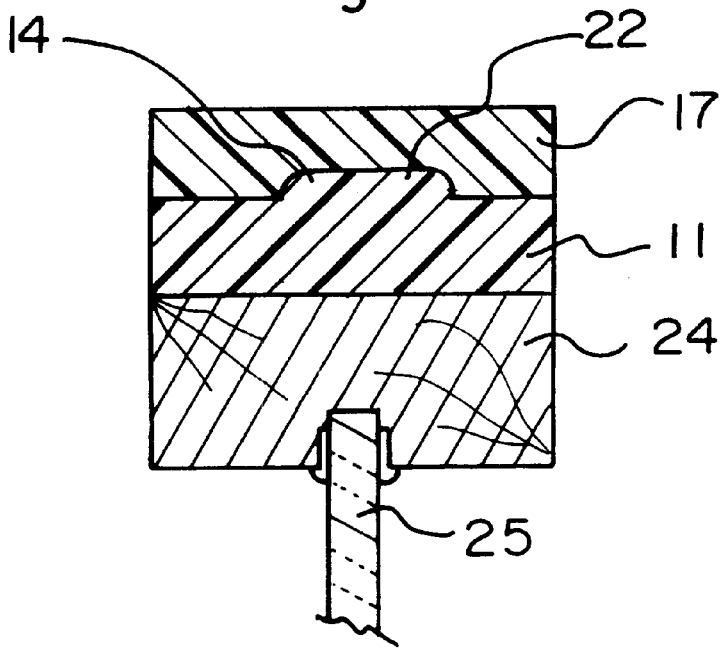
FIG. 4 is a cross-sectional view of the window frame, window molding, and frame of the present invention.

With reference now to the drawings, and in particular to FIGS. 1 through 4 thereof, a new decorative window-mounting apparatus embodying the principles and concepts of the present invention and generally designated by the reference numeral 10 will be described.

As best illustrated in FIGS. 1 through 4, the decorative window-mounting apparatus 10 generally comprises a window molding 11 which is adapted to securely attach to a window frame 24. The window molding 11 is essentially a four-sided structure, and includes a first pair of vertically-disposed elongate members 12,13 being adapted to securely mount with fasteners 26 to the window frame 24 to either side of the window 25, and also includes a horizontally-disposed upper cross member 15 having ends which are securely and conventionally attached to ends of the first pair of vertically-disposed elongate members 12,13 and is adapted to securely and conventionally attach to the window frame 24 above a window 25, and further includes a horizontally-disposed lower cross member 16 having ends which are securely and conventionally attached to other ends of the first pair of vertically-disposed elongate members 12,13 and being adapted to securely and conventionally attach to the window frame 24 below the window 25. Each of the first pair of vertically-disposed elongate members 12,13 includes an outer side which faces away from the other of the first pair of vertically-disposed elongate members 12,13 and each of the upper and lower cross members 15,16 having an outer side which faces away from the other cross member 15,16 with the outer sides having bosses 14 extending outwardly therefrom.

A frame 17 is securely and detachably mounted about the window molding 11 and is essentially a four-sided structure. The frame 17 includes a second pair of vertically-disposed elongate members 18,19 being spaced apart and each being detachably mounted to the outer side of a respective one of the first pair of vertically-disposed elongate members 18,19, and further includes a second pair of horizontally-disposed cross members 20,21 each of which has ends being securely and conventionally attached to ends of the second pair of vertically-disposed elongate members 18,19, one 20 of the second pair of horizontally-disposed cross members 20,21 being securely and detachably mounted upon an outer side of the horizontally-disposed upper cross member 15, and the other 21 of the cross members 20,21 being securely and detachably mounted to an outer side of the horizontally-disposed lower cross member 16. Each of the second pair of vertically-disposed elongate members 18,19 has an inner side which faces the outer side of a respective one of the first pair of vertically-disposed elongate members 12,13, and each of said second pair of cross members 20,21 has an inner side facing said outer side of a respective one of said upper and lower cross members 15,16. The inner sides have notches 22 therein with the notches 22 being adapted to receive the bosses 14 to effectively retain the frame 17 about the window molding 11. The frame 17 further includes window shutters which are adapted to close over the window 25.

A plurality of decorative members 23 are securely and conventionally attached to the frame 17 and extend outwardly therefrom. The decorative members 23 are made of vinyl and include various shapes identifying a particular holiday such as Christmas, Thanksgiving, New Years, and Halloween with the shapes including hearts, ghosts, pumpkins, reindeer, snowmen, bunnies, shamrocks.

In use, once the window molding 11 is securely fastened to the window frame 24 about the window 25, the user can easily and conveniently detachably mount the frame 17 about the window molding 11 with the holiday decorative members being securely attached about the frame 17 to provide decorations about a window 25 either inside or outside the house.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative window-mounting apparatus comprising:

a window molding for attaching to a window frame, said window molding comprising a four-sided structure;

a frame being detachably mounted about said window molding, said frame comprising a four-sided structure, and a plurality of decorative members attached to said frame and extending outwardly therefrom;

wherein said window molding includes a first pair of clongate members for mounting to the window frame to sides of the window, said window molding including an upper cross member having ends which are attached to first ends of said first pair of elongate members for mounting to the window frame above a window, said window molding including a lower cross member having ends which are attached to second ends of said first pair of elongate members for mounting to the window frame below the window, said upper and lower cross members being oriented substantially perpendicular to said first pair of elongate members;

wherein each of said first pair of elongate members includes an outer side which faces away from the other of said first pair of elongate members, and each of said cross members having an outer side which faces away from the other of said cross members, said outer sides having bosses extending outwardly therefrom.

2. A decorative window-mounting apparatus as described in claim 1, wherein said frame includes a second pair of elongate members being spaced apart and each being detachably mounted to said outer side of a respective one of said first pair of elongate members, and further includes a second pair of cross members each of which has ends being attached to ends of said second pair of elongate members, one of said second pair of cross members being detachably mounted upon an outer side of a said upper cross member, and the other of said cross members being detachably mounted to an outer side of said lower cross member.

3. A decorative window-mounting apparatus as described in claim 2, wherein each of said second pair of elongate members has an inner side which faces said outer side of a respective one of said first pair of elongate members, and each of said second pair of cross members has an inner side facing said outer side of a respective one of said upper and lower cross members, said inner sides having notches therein, said notches being adapted to receive said bosses to retain said frame about said window molding.

4. A decorative window-mounting apparatus as described in claim 1, wherein said decorative members are made of vinyl.

5. A decorative window-mounting apparatus as described in claim 1, wherein said decorative members have a shape corresponding to a particular holiday, said shape being selected from the group of shapes including hearts, ghosts, pumpkins, reindeer, snowmen, bunnies, shamrocks.

6. A decorative window-mounting apparatus as described in claim 1, wherein said frame includes window shutters for closing over a window when said frame is mounted on a window.

7. A decorative window-mounting apparatus comprising:

a window molding which is adapted to securely attach to a window frame, said window molding being essentially a four-sided structure;

a frame being securely and detachably mounted about said window molding and being essentially a four-sided structure; and a plurality of decorative members securely attached to said frame and extending outwardly therefrom;

wherein said window molding includes a first pair of vertically-disposed elongate members being adapted to securely mount to the window frame to either side of the window, and also includes a horizontally-disposed upper cross member having ends which are securely attached to ends of said first pair of vertically-disposed elongate members and being adapted to securely attach to the window frame above a window, and further includes a horizontally-disposed lower cross member having ends which are securely attached to other ends of said first pair of vertically-disposed elongate members and being adapted to securely attach to the window frame below the window;

wherein each of said first pair of vertically-disposed elongate members includes an outer side which faces away from the other of said first pair of vertically-disposed elongate members, and each of said cross members having an outer side which faces away from the other of said cross members, said outer sides having bosses extending outwardly therefrom.

8. A decorative window-mounting apparatus as described in claim 7, wherein said frame includes a second pair of vertically-disposed elongate members being spaced apart and each being detachably mounted to said outer side of a respective one of said first pair of vertically-disposed elongate members, and further includes a second pair of horizontally-disposed cross members each of which has ends being securely attached to ends of said second pair of vertically-disposed elongate members, one of said second pair of horizontally-disposed cross members being securely and detachably mounted upon an outer side of a said horizontally-disposed upper cross member, and the other of said cross members being securely and detachably mounted to an outer side of said horizontally-disposed lower cross member.

9. A decorative window-mounting apparatus as described in claim 8, wherein each of said second pair of vertically-disposed elongate members has an inner side which faces said outer side of a respective one of said first pair of vertically-disposed elongate members, and each of said second pair of cross members has an inner side facing said outer side of a respective one of said upper and lower cross members, said inner sides having notches therein, said notches being adapted to receive said bosses to effectively retain said frame about said window molding.

10. A decorative window-mounting apparatus as described in claim 7, wherein said decorative members are made of vinyl.

11. A decorative window-mounting apparatus as described in claim 7, wherein said decorative members include various shapes identifying a particular holiday, said shapes including hearts, ghosts, pumpkins, reindeer, snowmen, bunnies, shamrocks.

12. A decorative window-mounting apparatus as described in claim 7, wherein said frame includes window shutters which are adapted to close over the window.

13. A decorative window-mounting apparatus comprising:

a window molding which is adapted to securely attach to a window frame, said window molding being essentially a four-sided structure, said window molding including a first pair of vertically-disposed elongate members being adapted to securely mount to the window frame to either side of the window, and also including a horizontally-disposed upper cross member having ends which are securely attached to ends of said first pair of vertically-disposed elongate members and being adapted to securely attach to the window frame above a window, and further including a horizontally-disposed lower cross member having ends which are securely attached to other ends of said first pair of vertically-disposed elongate members and being adapted to securely attach to the window frame below the window, each of said first pair of vertically-disposed elongate members including an outer side which faces away from the other of said first pair of vertically-disposed elongate members and each of said cross members having an outer side which faces away from the other of said cross member, said outer sides having bosses extending outwardly therefrom;

a frame being securely and detachably mounted about said window molding and being essentially a four-sided structure, said frame including a second pair of vertically-disposed elongate members being spaced apart and each being detachably mounted to said outer side of a respective one of said first pair of vertically-disposed elongate members, and further including a second pair of horizontally-disposed cross members each of which has ends being securely attached to ends of said second pair of vertically-disposed elongate members, one of said second pair of horizontally-disposed cross members being securely and detachably mounted upon an outer side of a said horizontally-disposed upper cross member, and the other of said cross members being securely and detachably mounted to an outer side of said horizontally-disposed lower cross member, each of said second pair of vertically-disposed elongate members having an inner side which faces said outer side of a respective one of said first pair of vertically-disposed elongate members, and each of said second pair of cross members having an inner side facing said outer side of a respective one of said upper and lower cross members, said inner sides having notches therein, said notches being adapted to receive said bosses to effectively retain said frame about said window molding, said frame including window shutters which are adapted to close over the window; and a plurality of decorative members securely attached to said frame and extending outwardly therefrom, said decorative members being made of vinyl, said decorative members including various shapes identifying a particular holiday, said shapes including hearts, ghosts, pumpkins, reindeer, snowmen, bunnies, shamrocks.

* * * * *